US010070757B2

(12) United States Patent
Jacob

(10) Patent No.: US 10,070,757 B2
(45) Date of Patent: Sep. 11, 2018

(54) SHOWER ENCLOSURE DOOR SYSTEM

(71) Applicant: Rubens Jacob, Miami, FL (US)

(72) Inventor: Rubens Jacob, Miami, FL (US)

( * ) Notice: Subject to any disclaimer, the term of this patent is extended or adjusted under 35 U.S.C. 154(b) by 196 days.

(21) Appl. No.: 14/989,899

(22) Filed: Jan. 7, 2016

(65) Prior Publication Data

US 2017/0196412 A1 Jul. 13, 2017

(51) Int. Cl.

| | |
|---|---|
| ***A47K 3/00*** | (2006.01) |
| ***A47K 3/34*** | (2006.01) |
| ***E05D 15/06*** | (2006.01) |
| ***E05D 15/08*** | (2006.01) |

(52) U.S. Cl.

CPC ..... *A47K 3/34* (2013.01); *E05D 15/063* (2013.01); *E05D 15/0652* (2013.01); *E05D 15/0656* (2013.01); *E05D 15/08* (2013.01); *E05Y 2800/672* (2013.01); *E05Y 2900/114* (2013.01); *E05Y 2900/30* (2013.01)

(58) Field of Classification Search

USPC ..... 4/610, 557

See application file for complete search history.

(56) References Cited

U.S. PATENT DOCUMENTS

| | | | | |
|---|---|---|---|---|
| RE24,508 E | | 3/1954 | Grossman | |
| 2,699,827 A | * | 1/1955 | Carson | A47K 3/362 16/260 |
| 2,761,533 A | | 9/1956 | Grossman | |
| 2,885,000 A | * | 5/1959 | Merrill | A47K 3/362 16/90 |
| 3,359,573 A | | 12/1967 | Casebolt | |
| 3,783,456 A | * | 1/1974 | Doan | A47K 3/34 4/557 |
| 4,178,718 A | | 12/1979 | Laby | |
| 4,245,614 A | | 6/1981 | Hurwitz et al. | |
| 4,276,919 A | | 7/1981 | Walters | |
| 4,445,239 A | | 5/1984 | Jacobsen | |
| 4,458,449 A | | 7/1984 | Breuer | |
| 4,785,485 A | * | 11/1988 | Etesam | A47K 3/34 4/557 |
| 5,598,666 A | | 2/1997 | Kurth | |
| 5,852,837 A | | 12/1998 | Husting | |
| 6,023,794 A | | 2/2000 | Nein | |
| 6,381,904 B1 | | 5/2002 | Tedescucci | |
| 7,346,939 B2 | | 3/2008 | Perry | |
| 8,915,019 B2 | | 12/2014 | Schachter et al. | |

(Continued)

FOREIGN PATENT DOCUMENTS

CN 203879043 U 10/2014

*Primary Examiner* — Lauren Crane
(74) *Attorney, Agent, or Firm* — Albert Bordas, P.A.

(57) ABSTRACT

A shower enclosure door system, having a header with a channel defined between first and second ends. The header further has at least first, second, third, and fourth roller assemblies that travel upon the channel. The first and second brackets receive the first and second ends respectively. The first and second brackets mount onto lateral walls to define a shower enclosure. A base assembly comprises third and fourth ends. First and second base brackets mount upon the third and fourth ends respectively. The base assembly mounts onto a mounting surface for the shower enclosure. The first and second brackets support a weight of shower doors of the shower enclosure without side jambs while the shower doors bypass one another.

14 Claims, 4 Drawing Sheets

(56) References Cited

U.S. PATENT DOCUMENTS

| | | | |
|---|---|---|---|
| D729,049 | S | 5/2015 | Andren |
| 9,062,485 | B2 | 6/2015 | Guidos et al. |
| 2011/0005140 | A1 | 1/2011 | Guidos et al. |
| 2011/0072613 | A1 | 3/2011 | Hays |
| 2015/0164284 | A1 | 6/2015 | Sprague |

* cited by examiner

SHOWER ENCLOSURE DOOR SYSTEM

BACKGROUND OF THE INVENTION

1. Field of the Invention

The present invention relates to shower door systems, and more particularly, to shower enclosure door systems with bypass shower doors.

2. Description of the Related Art

Applicant believes that one of the closest references corresponds to U.S. Patent Application Publication No. 20150164284 A1, published on Jun. 18, 2015 to Gary Sprague for a Sliding Shower Door Assembly. However, it differs from the present invention because Sprague teaches a fully frameless sliding shower door assembly. The assembly dispenses with the need for vertical framing members by using a panel of sufficient strength to be fully self-supporting. The need for an upper horizontal header member is eliminated by using a unique upper guide assembly wherein the guide is fixed to the movable shower door and configured to slide about a top edge of the stationary shower door. The need for a lower horizontal rail member is eliminated by the use of a unique, self-centering roller assembly that is attachable to the door panel without the need for a rail member. The roller assembly features matching inverted and non-inverted generally U-shaped profiles on the roller and track, respectively. The shower door assembly further features inboard and outboard roller finger guards, as well as a track leveling feature, which improves ease of installation.

Applicant believes that another reference corresponds to U.S. Patent Application Publication No. 20110072613 A1, published on Mar. 31, 2011 to James Hays for Spring Biased Roller for a Shower Door or the Like. However, it differs from the present invention because Hays teaches a roller for slidably mounting a panel such as a shower door to a rail or to a similar structure. The roller comprises a first cylindrical portion including a rolling surface for engaging the rail and a second cylindrical portion fixedly securable to the shower door panel. The second portion is concentrically mounted to the first portion and is rotatable relative thereto. A resilient member such as a tension spring connects the first portion to the second portion and stores a potential energy when a user moves the shower door in one direction and automatically urges the shower door to move in the opposite direction when released by the user.

Applicant believes that another reference corresponds to U.S. Patent Application Publication No. 20110005140 A1, published on Jan. 13, 2011 to Michael John Guidos et al. for Articulating Roller Arm Assembly. However, it differs from the present invention because Guidos el at. teaches an articulating roller arm assembly comprising a single integral piece cantilever beam with a span section and a throw section, with the span section oriented substantially transverse the throw section. A first distal end of the throw section and a distal end of the span section form a bend of the single integral piece cantilever beam. The articulating roller arm assembly further including a first wheel that is coupled with a first distal end of the throw section, and a second wheel that is coupled with a second distal end of the throw section.

Applicant believes that another reference corresponds to U.S. Pat. No. 9,062,485 B2 issued to Michael John Guidos et al. on Jun. 23, 2015 for Articulating Roller Arm Assembly. However, it differs from the present invention because Guidos et al. teaches an articulating roller arm assembly comprising a single integral piece cantilever beam with a span section and a throw section, with the span section oriented substantially transverse the throw section. A first distal end of the throw section and a distal end of the span section form a bend of the single integral piece cantilever beam. The articulating roller arm assembly further including a first wheel that is coupled with a first distal end of the throw section, and a second wheel that is coupled with a second distal end of the throw section.

Applicant believes that another reference corresponds to U.S. Pat. No. 8,915,019 B2 issued to Robert Schachter et al. on Dec. 23, 2014 for Sliding Door Stopper System. However, it differs from the present invention because Schachter et al. teaches a sliding door assembly for use with a tub or shower enclosure. The assembly comprising a rod, having a first end and a second end extending along said enclosure. At least one door, having a top, bottom, first end, second end, first surface and second surface. At least one roller attached to said door at a predetermined position and slidably engaging said rod. A stopper attached to said rod, at a predetermined position. A striker attached to said door, at a predetermined position. The striker further comprising at least one striking member. The stopper further comprising at least one striking member receiver, wherein when said door is in a first position, said at least one striking member and said at least one striking member receiver are not engaged and when said door is in a second position, said at least one striking member and said at least one striking member receiver are engaged, preventing said at least one door from substantial horizontal and vertical movement along said rod.

Applicant believes that another reference corresponds to U.S. Pat. No. 7,346,939 B2 issued to Edward A. Perry on Mar. 25, 2008 for Triple Slide Frameless Shower Door. However, it differs from the present invention because Perry teaches a sliding door assembly including at least three frameless panels that are slidably installed to form a door to an enclosed tub or shower area. Each frameless panel is gripped at a top by at least two roller assemblies, and the roller assemblies are slidably suspended from a header that supports the frameless panels via the roller assemblies. The sliding door assembly also includes a guide assembly that has at least three tracks, wherein each frameless panel is guided by a corresponding one of the tracks.

Applicant believes that another reference corresponds to U.S. Pat. No. 6,381,904 B1 issued to Joseph F. Tedescucci on May 7, 2002 for Track Mounted Bath Doors with Clip Anti-Derailer. However, it differs from the present invention because Tedescucci teaches a door system for an enclosure such as a shower enclosure, including sliding doors suspended from hanging brackets, which are attached to rails mounted to an opening of the enclosure. The hanging brackets include rollers, which roll along the rails enabling the doors to slide with respect to the rails. The hanging brackets include anti-derailer clips snap fitted onto the brackets after the doors are hung from the rails to prevent the doors from being removed from the rails. The clips each have flexible catches at their top and bottom, as well as projections on a side to align their position with respect to the brackets.

Applicant believes that another reference corresponds to U.S. Pat. No. 6,023,794 A issued to John H. Nein on Feb. 15, 2000 for Shower Door Assembly. However, it differs from the present invention because Nein teaches a sliding door system for a shower-bathtub installed adjacent to three walls of a bathroom. The sliding door system includes an upper track that has at least two wheel supports, at least two wheel stays positioned above the two wheel supports, and at least two lower bearing supports positioned at least five inches below the two wheel supports. The upper track is rigidly attached to the two short walls of the shower-bathtub and provides enough support so that the presence of a lower track is unnecessary.

Applicant believes that another reference corresponds to U.S. Pat. No. 5,852,837 A issued to Thomas J. Husting on Dec. 29, 1998 for Multiple Section Suspended Bath Doors with a Lower Stabilizer. However, it differs from the present invention because Husting teaches a door system including a sill having a ledge extending across the bottom of an opening to a bathing enclosure and having a raised lip along an exterior side of the ledge. A pair of parallel tracks are above the opening with a first door suspended from and slidable along the first track freely above the ledge. A second door and a third door are suspended from and slidable along the second track being freely suspended above the ledge. A pair of door retainers are attached to the first door and engage the other doors to prevent the doors from swinging into each other. A stop member is attached to the sill on an interior side of the ledge to retain three doors above the ledge between the stop member and the raised lip.

Applicant believes that another reference corresponds to U.S. Pat. No. 5,598,666 A issued to Michael J. Kurth on Feb. 4, 1997 for Anti-Derailing Mechanism for Track Mounted Bath Doors. However, it differs from the present invention because Kurth teaches a door system for a bathing enclosure, which includes a track extending above an opening of the enclosure with the track having a rail with an upper surface having a longitudinal groove. A door has first and second rollers, which ride in the rail groove, so that the door is suspended from and slidable along the track. A separate stop is associated with each roller with each stop having a first locking bracket fixed to the door and a member is movably attached to the locking bracket. The members are adjustable between a first position at which the first roller may be removed from the groove and a second position at which the first member strikes the track before the first roller can be removed from the groove.

Applicant believes that another reference corresponds to U.S. Pat. No. 4,458,449 A issued to Horst Breuer on Jul. 10, 1984 for Separation for Showers, Bathtubs, or the Like. However, it differs from the present invention because Breuer teaches a separation for showers, bathtubs, or the like, including: a stationary, closed frame, made of several frame parts, for guiding at least one movable door element, and, if appropriate, for fastening a stationary door element. The at least one movable door element is suspended by rollers on the upper frame part of the frame. A seal for sealing the closed separation against discharging splashed or sprayed water. A closed lower frame part of the stationary frame, this lower frame part having a box-like cross section, an upwardly directed narrowed portion of predetermined height and width, and an inclined run-off surface adjoining one side of the narrowed portion; and a movable door element, the lower frame part of which faces the mentioned frame part of the stationary frame, and is provided with a downwardly open recess which conforms to the narrowed portion of the stationary frame part.

Applicant believes that another reference corresponds to U.S. Pat. No. 4,445,239 A issued to Ralph E. Jacobsen on May 1, 1984 for Suspended Shower-tub Doors with Upper Stabilizing Means. However, it differs from the present invention because Jacobsen teaches an upper horizontal rail structure that is stationarily supported in an elevated position above the upper marginal edge of the outer wall of the lower tub portion of a shower-tub area and defines three laterally spaced depending inner, outer and intermediate flange portions between which inner and outward downwardly opening channels are formed. A pair of upstanding inner and outer shower doors are provided including upper marginal edge portions slidably received in the corresponding channels and each upper marginal edge includes a pair of opposite end support rollers rollingly engaged with longitudinally extending track structure in the corresponding channel. In addition, the upper marginal edge portion of each door includes opposite end inner and outer guide roller structure journalled therefrom about upstanding axes and projecting outwardly from at least the inner and outer sides, respectively, of the door upper marginal edge portion below the support rollers thereof and above the lower marginal edges of the corresponding flange portions. The guide rollers are disposed for rolling engagement with the opposing surfaces of the corresponding flange portions and adjustably mounted from the corresponding doors for shifting laterally thereof. The lower marginal edges of the doors are disposed adjacent to the upper marginal edge of the outer wall of the associated tub portion and are free of guided engagement therewith.

Applicant believes that another reference corresponds to U.S. Pat. No. 4,245,614 A issued to Mathew Hurwitz et al. on Jan. 20, 1981 for Fireplace Screen. However, it differs from the present invention because Hurwitz teaches a glass panelled fireplace screen having sliding doors within a frame. The joints between the doors and the frame and between adjacent doors provide novel seals for effectively impeding the passage of air when the doors are in closed position. The screen includes thermostatically operated means, which automatically opens the draft control when a fire is burning in the fireplace and which closes the draft control when the fire is out.

Applicant believes that another reference corresponds to U.S. Pat. No. 4,276,919 A issued to Kenneth I. Walters on Jul. 7, 1981 for Enclosure Doors. However, it differs from the present invention because Walters teaches an enclosure for a tub or shower comprising a pair of sliding doors, which can fold relative to each other along a vertical junction. Each door is supported by an offset hanger and is pivotal about its hanger. The hangers include rollers, which slide within an overhead track. The doors can be functioned to slide along the track, to pivot about the hangers and to fold together to fully expose the interior of the enclosure.

Applicant believes that another reference corresponds to U.S. Pat. No. 4,178,718 A issued to Jordan M. Laby on Dec. 18, 1979 for Door Assembly for a Tub and Shower Enclosure. However, it differs from the present invention because Laby teaches a pair of roller and track suspended glass doors assembled with a tub or shower enclosure without drilling or piercing the door panels. Compression clamps depending from the rollers grip the upper edge of each panel. Adhesive pads support combined handles and towel bars on obverse and reverse side of alternate panels. A central bottom guide track is snapped into and adhesively secured to the bottom frame member. The bottom frame member includes an upright outside flange with an inwardly extending rubbing bar to preclude outer panel abrasion. End guides for the inner door panel are fixed to upright side members of the frame. The upright members support the frame header, which contains the top track for the rollers and may be contoured to accept a trim panel on the outer face thereof.

Applicant believes that another reference corresponds to U.S. Pat. No. 3,359,573 A issued to Ralph T. Casebolt on Dec. 26, 1967 for Glass Shower Enclosure Door. However, it differs from the present invention because Casebolt teaches glass doors of the sliding type used as an intergral portion of a shower and bath tub enclosure or the like.

Applicant believes that another reference corresponds to U.S. Pat. No. 2,761,533 A issued to H. Grossman on Sep. 4, 1956 for Shower Door Enclosure Structure. However, it differs from the present invention because Grossman teaches a shower door enclosure structure. It provides shower-enclosure door-frame members and mounting fixtures of a form and arrangement which will permit quick and easy assembly and installation at the point of use; to provide improved shower-door frame members and mounting fixtures of this kind which suspend the doors on rollers operating in concealed tracks and retain the doors vertically during movement by concealed guideways; and to provide improved door-frame members and mounting fixtures of this kind which are simple in construction and ornamental in appearance, making possible economic manufacture and shipment in completely knockdown or disassembled form and easy assembly and mounting by the purchasers with little or no experience, using locally-obtained door panels.

Applicant believes that another reference corresponds to U.S. Reexamination No. RE24508 E issued to Harold Grossman on Mar. 31, 1954 for Shower Door Enclosure Structure. However, it differs from the present invention because Grossman teaches shower door enclosure structures. Shower-enclosure door-frame members and mounting fixtures of a form and arrangement, which will permit quick and easy assembly and installation at the point of use; to provide improved shower-door frame members and mounting fixtures of this kind which suspend the doors on rollers operating in concealed tracks and retain the doors vertically during movement by concealed guideways; and to provide improved door-frame members and mounting fixtures of this kind which are simple in construction and ornamental in appearance, making possible economic manufacture and shipment in completely knockdown or disassembled form and easy assembly and mounting by the purchasers with little or no experience, using locally—obtained door panels.

Applicant believes that another reference corresponds to U.S. Pat. No. D729,049 S issued to Stefan B. Andren on May 12, 2015 for Roller Mount. However, it differs from the present invention because Andren roller mount design is different from Applicant's.

Applicant believes that another reference corresponds to Chinese Patent No. CN 203879043 U issued to Shen Jinzhao et al. on Oct. 15, 2014 for Novel Simple Shower House. However, it differs from the present invention because Jinzhao et al. teaches a shower house comprising a base basin, a first fixing glass door and a second fixing glass door. A first movable glass door is disposed in the first fixing glass door; a second movable glass door is disposed in the second fixing glass door; a first upper track is fastened on the upper end of the first fixing glass door; a second upper track is fastened on the upper end of the second fixing glass door. The external end of the first upper track and the external end of the second upper track are fixedly sleeved together via an upper connection member. A plurality of rollers are respectively fastened the first movable glass door and the second movable glass door. A U-shaped groove is arranged on each roller work surface. The first movable glass door and the second movable glass door are suspended on a corresponding track via the rollers. The internal and external ends of the first upper track and the external and internal ends of the second upper track are respectively provided with a spacing block; and each spacing block is fixedly connected with the corresponding upper track.

Other patents describing the closest subject matter provide for a number of more or less complicated features that fail to solve the problem in an efficient and economical way. None of these patents suggest the novel features of the present invention.

SUMMARY OF THE INVENTION

The present invention is a shower enclosure door system, and more particularly, a shower enclosure door system that does not have side jambs for supporting shower doors and their weight, but still permits the opening of both sliding shower doors making it a bypass.

More specifically, the present invention is a shower enclosure door system, comprising a header with a channel defined between first and second ends. The header further comprises at least first, second, third, and fourth roller assemblies that travel upon the channel. The first and second brackets receive the first and second ends respectively. The first and second brackets mount onto lateral walls to define a shower enclosure. A base assembly comprises third and fourth ends. First and second base brackets mount upon the third and fourth ends respectively. The base assembly mounts onto a mounting surface for the shower enclosure. The first and second brackets support a weight of shower doors of the shower enclosure without side jambs while the shower doors bypass one another.

The first, second, third, and fourth roller assemblies each comprise a frame securing a roller and a bushing. A pair of bushings secures each shower door. The frame further comprises a pin. Each of the first and second brackets comprises an exterior wall, an interior wall, a bottom wall, and a sidewall. Each sidewall comprises at least one hole to receive fastening means to mount onto the lateral walls of the shower enclosure. The sidewall may also comprise an adhesive element to mount onto the laterals walls of the shower enclosure. The exterior wall and the interior wall are parallel to each other. The sidewall is perpendicular to the exterior wall, interior wall, and bottom wall. The exterior wall, interior wall, and bottom wall extend a predetermined distance from the sidewall. The base assembly comprises at least first and second holes to receive fastening means to mount onto the mounting surface for the shower enclosure. The first and second base brackets comprise a base and an exterior face. The base comprises an adhesive element to mount onto the mounting surface for the shower enclosure. The base assembly comprises a guide element assembly. The guide element assembly comprises a guide frame. The guide frame comprises at least one guide. The shower door travels between at least two of the guides.

It is therefore one of the main objects of the present invention to provide a shower enclosure door system without side jambs.

It is another object of this invention to provide a shower enclosure door system that supports shower doors and their weight.

It is another object of this invention to provide a shower enclosure door system that permits the opening of both sliding shower doors making it a bypass.

It is another object of this invention to provide a shower enclosure door system that is easily adjustable without need of any further resizing work.

It is another object of this invention to provide a shower enclosure door system that can mount onto laterals walls and a mounting surface to define a shower enclosure.

It is another object of this invention to provide a shower enclosure door system, which both doors can be slid from end to end without interfering.

It is another object of this invention to provide a shower enclosure door system, which is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
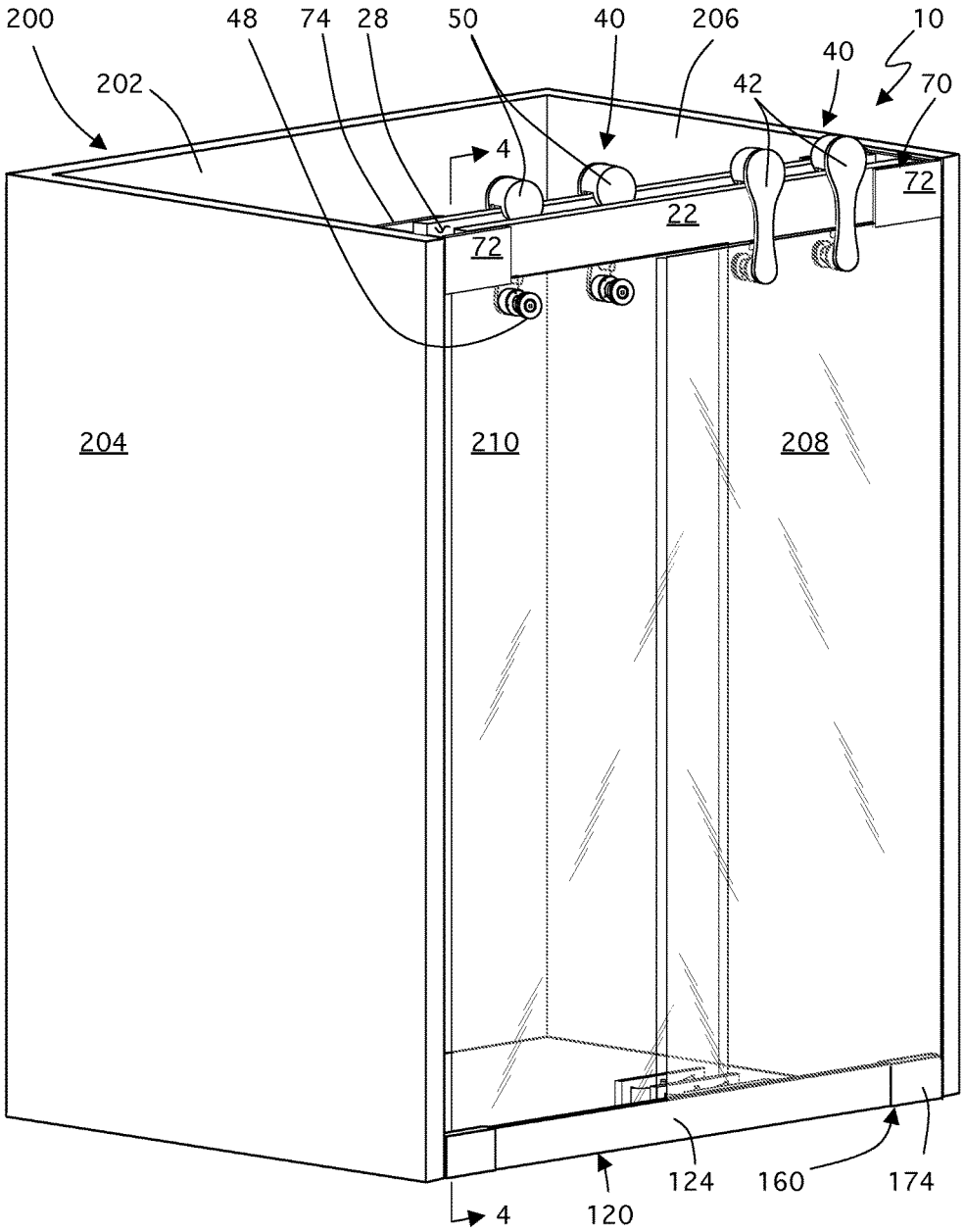
FIG. 1 represents an isometric view of a shower enclosure door system installed onto a shower enclosure.

Referring now to the drawings, the present invention is a shower enclosure door system and is generally referred to with numeral 10. It can be observed that it basically includes header 20, roller assemblies 40, brackets 70, base assembly 120, and base brackets 160

As seen in FIG. 1, present invention 10 is installed onto shower enclosure 200. In the preferred embodiment, shower enclosure 200 comprises rear wall 202, lateral walls 204 and 206, and shower doors 208 and 210.

Figure 2:
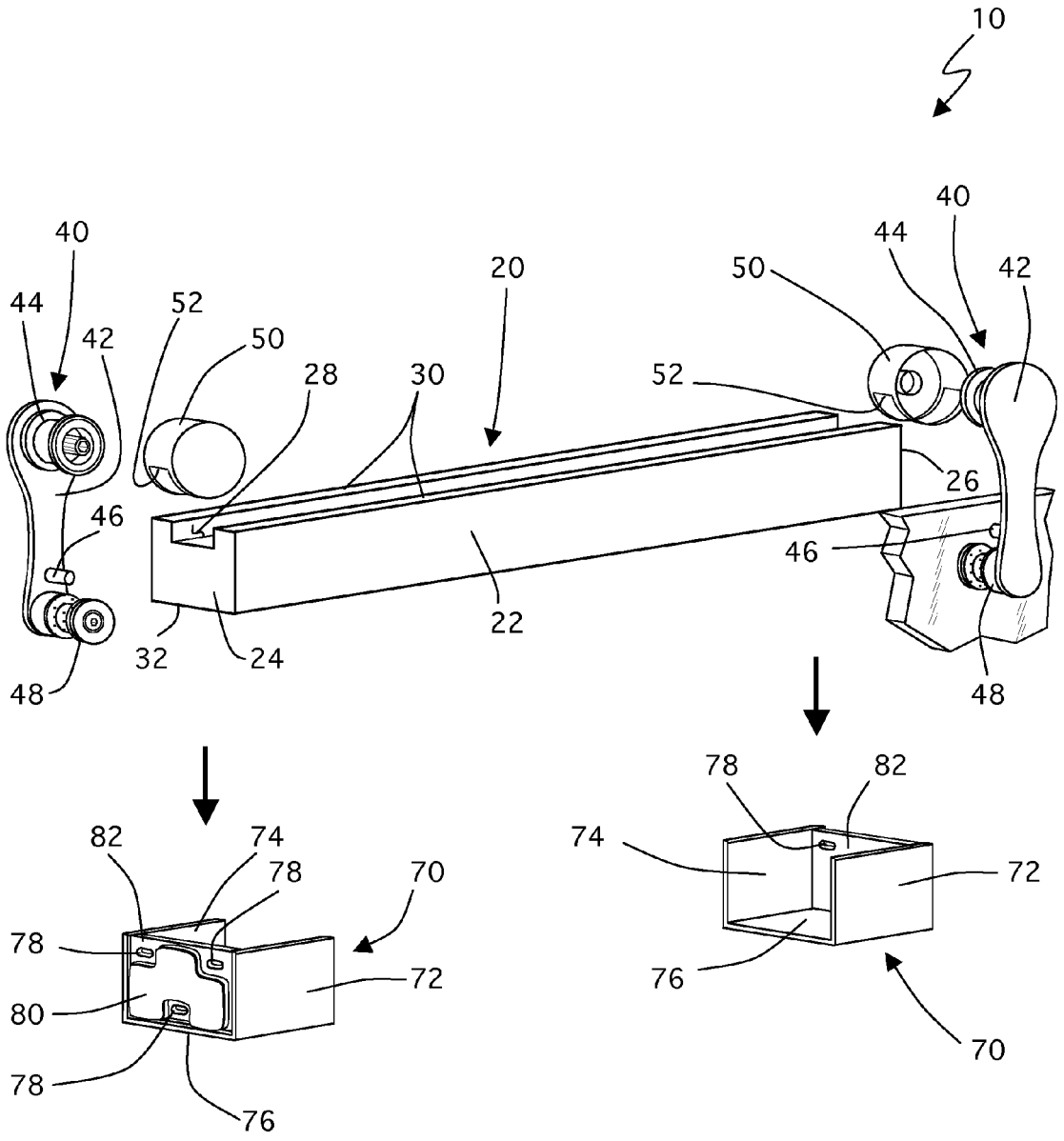
FIG. 2 is an isometric exploded view of a header, roller assemblies, and brackets.

As seen in FIGS. 1 and 2, header 20 comprises channel 28 defined between ends 24 and 26. Header 20 comprises exterior face 22, top edges 30 that further define channel 28, and bottom face 32. At least first, second, third, and fourth roller assemblies 40 travel upon channel 28. Roller assemblies 40 each comprise frame 42 securing roller 44 and bushing 48. A first pair of bushings 48 secure shower door 208, and a second pair of bushings 48 secure shower door 210. Roller assemblies 40 also comprise covers 50 having cutouts 52 shaped to allow rollers 44 to partially protrude there through to ride upon channel 28.

First and second brackets 70 comprise exterior wall 72, interior wall 74, bottom wall 76, and sidewall 82. Sidewall 82 comprises at least one hole 78 to receive fastening means to mount onto lateral walls 204 and 206 of shower enclosure 200. Such fastening means may be screws, bolts, nails, rivets, and the like. In addition, sidewall 82 may comprise adhesive element 80 to mount onto lateral walls 204 and 206 of shower enclosure 200. Such an adhesive element 80 may be two-sided tape, glue, or the like.

In a preferred embodiment, exterior wall 72 and interior wall 74 are parallel to each other, and sidewall 82 is perpendicular to exterior wall 72, interior wall 74, and bottom wall 76. Exterior wall 72, interior wall 74, and bottom wall 76 extend a predetermined distance from sidewall 82.

First and second brackets 70 receive ends 24 and 26 respectively. First and second brackets 70 mount onto lateral walls 204 and 206 to define shower enclosure 200. It is noted that first and second brackets 70 support a weight of shower doors 208 and 210 without side jambs, whereby first and second brackets 70 mount directly onto lateral walls 204 and 206.

Figure 3A:
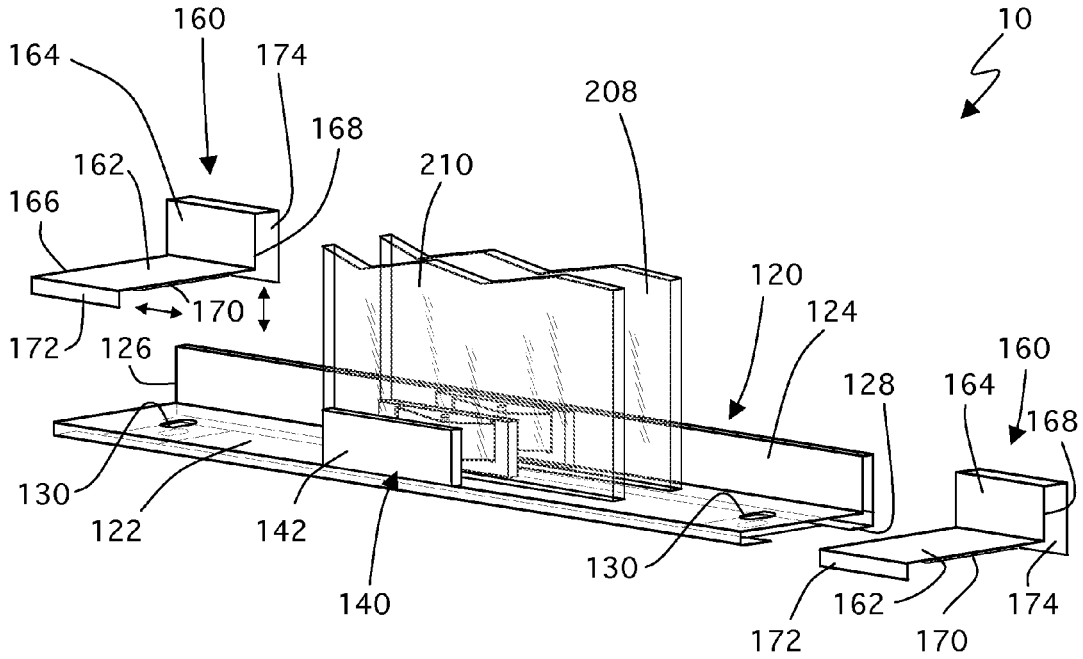
FIG. 3A is a rear isometric exploded view of a base assembly and base brackets with shower doors partially represented.
Figure 3B:
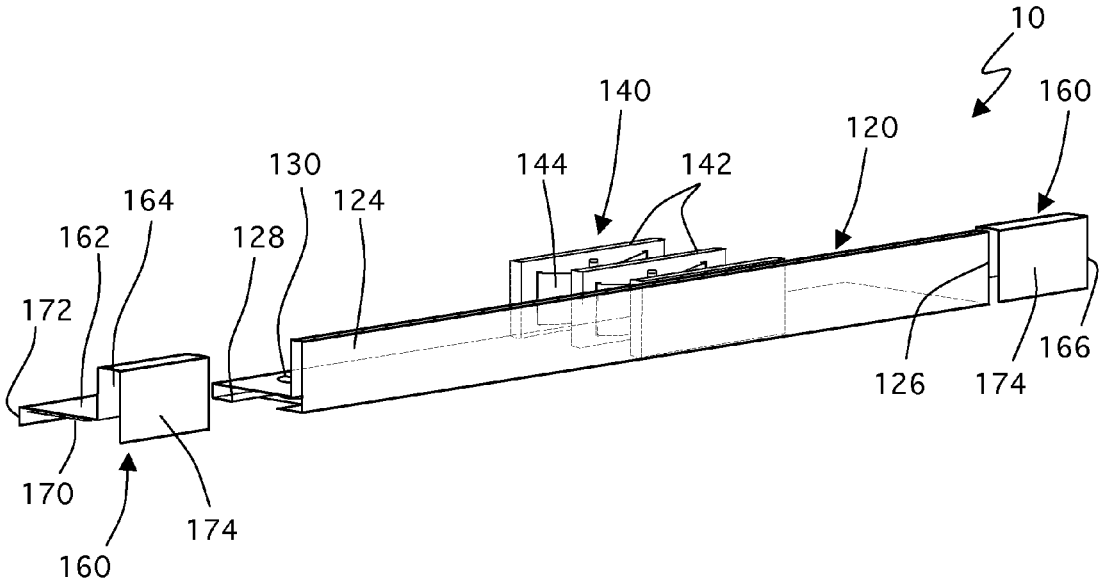
FIG. 3B is a front isometric exploded view of the base assembly and base brackets with the shower doors partially represented.

As seen in FIGS. 3A and 3B, base assembly 120 comprises ends 126 and 128. Base assembly 120 comprises elongated base 122 having holes 130 to receive fastening means to mount onto a mounting surface for shower enclosure 200, and interior wall 124. Such fastening means may be screws, bolts, nails, rivets, and the like. Holes 130 may be elongated. Base assembly 120 comprises guide element assembly 140 comprising guide frames 142. Each guide frame 142 comprises at least one guide 144 for shower doors 208 and 210 travel between at least two guides 144.

Figure 4:
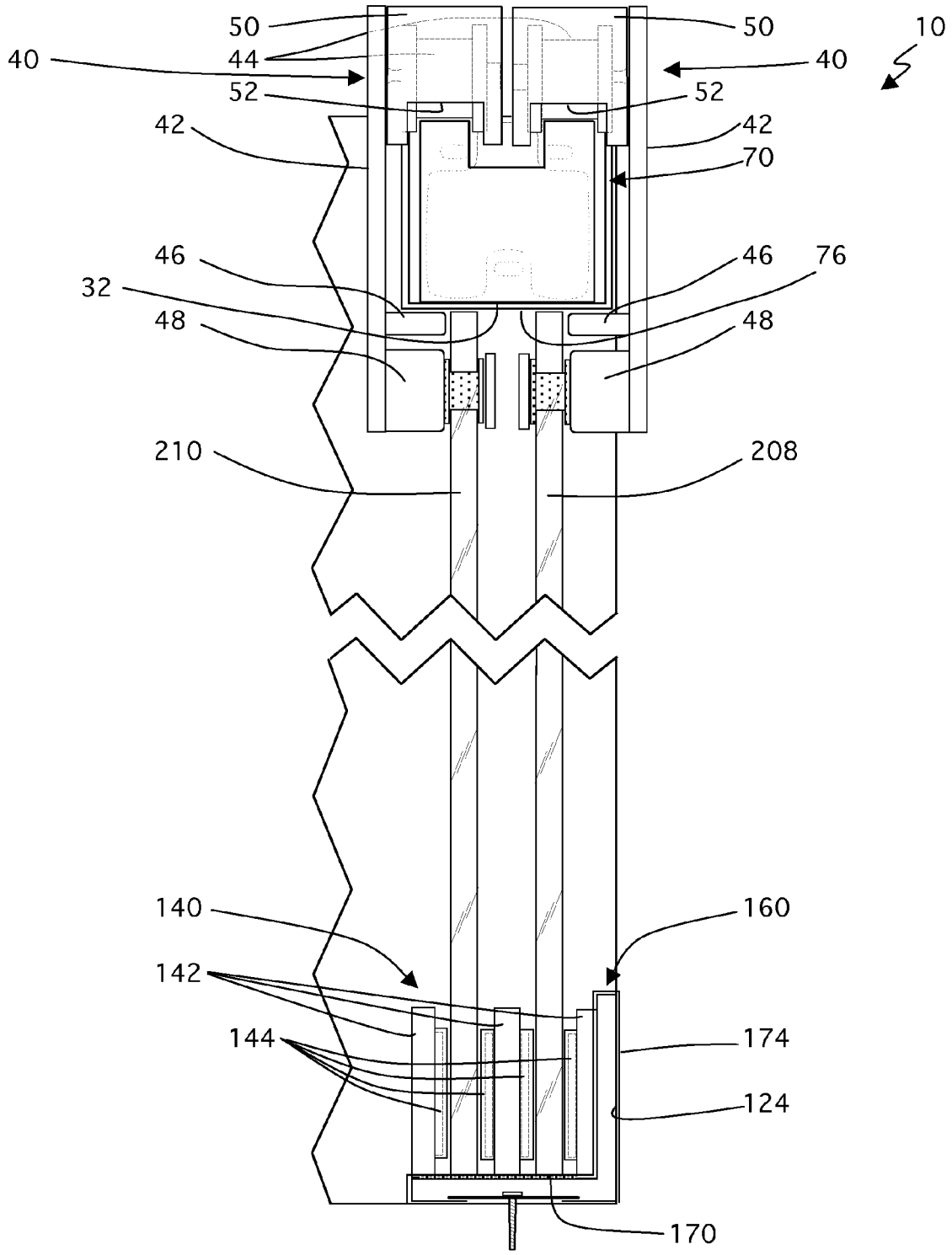
FIG. 4 is a side view of the shower enclosure door system taken along the lines 4-4, as seen in FIG. 1.

Base brackets 160 mount upon ends 126 and 128, and base assembly 120 mounts onto the mounting surface for shower enclosure 200. Such a mounting surface can be a threshold or sill as an example as seen in FIG. 4. Base brackets 160 comprise base 162, interior wall 164, interior edge 172, and exterior face 174, extending between ends 166 and 168.

Base brackets 160 comprise adhesive element 170 to mount onto base assembly 120. Such an adhesive element 170 may be two-sided tape, glue, or the like.

As best seen in FIG. 4, shower doors 208 and 210 bypass one another. Frame 42 further comprises pin 46. Pins 46 are sufficiently long and travel snugly below bottom face 32 to prevent rollers 44 from accidently lodging or coming off channel 28.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A shower enclosure door system, comprising:

A) a header comprising a channel defined between first and second ends and first and second parallel top edges, said header further comprising at least first, second, third, and fourth roller assemblies that travel upon said channel, said first, second, third, and fourth roller assemblies each comprise a frame securing a roller and a bushing, and each said frame comprises a respective pin;

B) first and second brackets that receive said first and second ends respectively, said first and second brackets mount onto lateral walls to define a shower enclosure, said first and second brackets support a weight of shower doors of said shower enclosure without side jambs, each said roller sits on a respective of said first and second parallel top edges to allow said shower doors bypass one another, and each said pin is sufficiently long and travels below a bottom face of said header to prevent each said roller from accidently lodging or coming off said channel;

C) a base assembly comprising third and fourth ends; and

D) first and second base brackets that mount upon said third and fourth ends respectively, said base assembly mounts onto a mounting surface for said shower enclosure.

2. The shower enclosure door system set forth in claim 1, further characterized in that a pair of said bushings secure a shower door.

3. The shower enclosure door system set forth in claim 1, further characterized in that each of said first and second brackets comprise an exterior wall, an interior wall, a bottom wall, and a sidewall.

4. The shower enclosure door system set forth in claim 3, further characterized in that each said sidewall comprises at least one hole to receive fastening means to mount onto said lateral walls of said shower enclosure.

5. The shower enclosure door system set forth in claim 3, further characterized in that each said sidewall comprises an adhesive element to mount onto said laterals walls of said shower enclosure.

6. The shower enclosure door system set forth in claim 3, further characterized in that said exterior wall and said interior wall are parallel to each other.

7. The shower enclosure door system set forth in claim 3, further characterized in that said sidewall is perpendicular to said exterior wall, said interior wall, and said bottom wall, and said exterior wall, said interior wall, and said bottom wall extend a predetermined distance from said sidewall.

8. The shower enclosure door system set forth in claim 1, further characterized in that said base assembly comprises at least first and second holes to receive fastening means to mount onto said mounting surface for said shower enclosure.

9. The shower enclosure door system set forth in claim 1, further characterized in that each of said first and second base brackets comprise a base and an exterior face.

10. The shower enclosure door system set forth in claim 9, further characterized in that each said base comprises an adhesive element to mount onto said mounting surface for said shower enclosure.

11. The shower enclosure door system set forth in claim 1, further characterized in that said base assembly comprises a guide element assembly.

12. The shower enclosure door system set forth in claim 11, further characterized in that said guide element assembly comprises a guide frame.

13. The shower enclosure door system set forth in claim 12, further characterized in that said guide frame comprises at least one guide.

14. The shower enclosure door system set forth in claim 13, further characterized in that a shower door travels between at least two said guides.

* * * * *